US012037994B2

(12) United States Patent
Ukai et al.

(10) Patent No.: US 12,037,994 B2
(45) Date of Patent: Jul. 16, 2024

(54) RECIPROCATING COMPRESSOR

(71) Applicant: IHI ROTATING MACHINERY ENGINEERING CO., LTD., Tokyo (JP)

(72) Inventors: Kouji Ukai, Tokyo (JP); Yosuke Matsubara, Tokyo (JP)

(73) Assignee: IHI ROTATING MACHINERY ENGINEERING CO., LTD., Tokyo (JP)

( * ) Notice: Subject to any disclaimer, the term of this patent is extended or adjusted under 35 U.S.C. 154(b) by 136 days.

(21) Appl. No.: 17/602,067

(22) PCT Filed: Feb. 10, 2020

(86) PCT No.: PCT/JP2020/005190
§ 371 (c)(1),
(2) Date: Oct. 7, 2021

(87) PCT Pub. No.: WO2020/208930
PCT Pub. Date: Oct. 15, 2020

(65) Prior Publication Data

US 2022/0178360 A1 Jun. 9, 2022

(30) Foreign Application Priority Data

Apr. 9, 2019 (JP) ..... 2019-074035

(51) Int. Cl.
*F04B 39/10* (2006.01)
*F04B 15/08* (2006.01)
(Continued)

(52) U.S. Cl.
CPC ..... *F04B 39/10* (2013.01); *F04B 15/08* (2013.01); *F04B 39/041* (2013.01); *F04B 39/06* (2013.01);
(Continued)

(58) Field of Classification Search
CPC ..... F04B 53/08; F04B 53/16; F04B 53/146; F04B 39/12; F04B 39/121; F04B 39/06;
(Continued)

(56) References Cited

U.S. PATENT DOCUMENTS 1,878,731 A * 9/1932 Paul ..... F16J 15/44 277/303
2,204,374 A * 6/1940 Metzgar ..... F04B 39/041 277/423
(Continued)

FOREIGN PATENT DOCUMENTS

CN 204827851 U 12/2015
CN 207004829 U 2/2018
(Continued)

*Primary Examiner* — Christopher S Bobish
(74) *Attorney, Agent, or Firm* — Rothwell, Figg, Ernst & Manbeck, P.C.

(57) ABSTRACT

A reciprocating compressor 1A includes a compression part 2 compressing, by a piston 6, gas sucked into a cylinder 4 through a suction valve 36, and discharging the compressed gas through a discharge valve 51, a piston drive part 3 supplying a force to the piston 6 to reciprocate the piston 6 via a piston rod 9 coupled to the piston 6, and a housing 17 accommodating the compression part 2 and forming a vacuum region around the compression part 2.

9 Claims, 5 Drawing Sheets

(51) Int. Cl.

| | |
|---|---|
| ***F04B 39/04*** | (2006.01) |
| ***F04B 39/06*** | (2006.01) |
| ***F04B 39/12*** | (2006.01) |
| ***F04B 53/08*** | (2006.01) |
| ***F04B 53/14*** | (2006.01) |
| ***F04B 53/16*** | (2006.01) |

(52) U.S. Cl.
CPC ..... *F04B 39/064* (2013.01); *F04B 39/12* (2013.01); *F04B 39/121* (2013.01); *F04B 53/08* (2013.01); *F04B 53/146* (2013.01); *F04B 53/16* (2013.01); *F04B 2015/081* (2013.01); *F04B 2015/082* (2013.01); *F04B 2015/0822* (2013.01)

(58) Field of Classification Search
CPC .. F04B 39/064; F04B 15/08; F04B 2015/081; F04B 2015/082; F04B 2015/0822; F04B 39/041
USPC ..... 277/411, 431
See application file for complete search history.

(56) References Cited

U.S. PATENT DOCUMENTS

| | | | | | |
|---|---|---|---|---|---|
| 2,621,087 | A * | 12/1952 | Kluge | F04D 29/102 | 277/927 |
| 2,831,325 | A * | 4/1958 | White | F04B 15/08 | 92/252 |
| 3,220,202 | A * | 11/1965 | Gottzmann | F04B 53/166 | 417/901 |
| 3,632,235 | A * | 1/1972 | Grenci | F17C 5/06 | 417/901 |
| 4,396,362 | A * | 8/1983 | Thompson | F04B 15/08 | 92/144 |
| 4,792,289 | A * | 12/1988 | Nieratschker | F04B 15/08 | 417/511 |
| 5,246,355 | A * | 9/1993 | Matzner | F04B 1/00 | 417/521 |
| 5,511,955 | A | 4/1996 | Brown et al. | | |
| 5,545,015 | A * | 8/1996 | Scherrer | F04D 7/02 | 417/901 |
| 7,086,841 | B2 * | 8/2006 | Cornwell | F04B 53/06 | 417/295 |
| 8,342,820 | B2 * | 1/2013 | Kwon | F04D 13/024 | 417/420 |
| 9,995,290 | B2 * | 6/2018 | Pollard | F04B 15/08 | |
| 10,584,692 | B2 * | 3/2020 | Mori | F04B 43/08 | |
| 2018/0120194 | A1 | 5/2018 | Roth | | |
| 2019/0186478 | A1 * | 6/2019 | Cappelli | F04B 39/0016 | |
| 2022/0074397 | A1 * | 3/2022 | Crispel | F04B 53/16 | |

FOREIGN PATENT DOCUMENTS

| | | | |
|---|---|---|---|
| EP | 1767783 | A1 | 3/2007 |
| JP | 8-261143 | A | 10/1996 |
| JP | 2008-232351 | A | 10/2008 |
| JP | 2012-163105 | A | 8/2012 |
| JP | 2013-68114 | A | 4/2013 |
| JP | 2017-20365 | A | 1/2017 |
| KR | 20160000138 | A | 1/2016 |

* cited by examiner

RECIPROCATING COMPRESSOR

CROSS REFERENCE TO RELATED APPLICATIONS

This application is a 35 U.S.C. 371 National Phase Entry Application from PCT/JP2020/005190, filed Feb. 10, 2020, which claims priority to Japanese Patent Application No. 2019-074035, filed Apr. 9, 2019, the disclosures of which is incorporated herein in its entirety by reference, and priority is claimed to the each of the foregoing.

TECHNICAL FIELD

The present disclosure relates to a reciprocating compressor.

BACKGROUND ART

Liquefied gas is contained in a storage or transport tank. In general, the liquefaction temperatures of gases are lower than ambient temperature. Liquefied gas contained in a tank thus vaporizes inside the tank due to heat input to the tank. Vaporized gas is referred to as boil-off gas (BOG). Vaporized gas (BOG) increases the internal pressure of the tank. The internal pressure of the tank is kept at a predetermined value by compressing the vaporized gas. The compressed vaporized gas is also pumped to other facilities.

Patent Literature 1 discloses a pressure control facility. This facility controls the internal pressure of a tank that stores low temperature liquefied gas. The facility is equipped with a BOG compressor that compresses the liquefied gas to a desired pressure. Patent Literature 1 gives the BOG compressor as an example of a reciprocating compressor.

CITATION LIST

Patent Literature

Patent Literature 1: Japanese Unexamined Patent Publication No. 2008-232351

SUMMARY OF INVENTION

Technical Problem

In recent years, hydrogen has attracted much attention as a new energy source. When using hydrogen as an energy source, it is envisioned that hydrogen is in a liquefied state during storage and transport, such as is natural gas. However, because the liquefaction temperature of hydrogen is lower than the liquefaction temperature of air, malfunctions caused by cryogenic liquid hydrogen may occur, if equipment such as reciprocating compressors for natural gas or the like is used as is for hydrogen. For example, liquefied air may be generated around the device to which the liquid hydrogen is supplied.

The present disclosure thus describes a reciprocating compressor that is capable of suppressing the generation of liquefied air.

Solution to Problem

A reciprocating compressor which is an embodiment of the present disclosure includes a compression part compressing, by a piston, gas sucked into a cylinder through a suction valve, and discharging the compressed gas through a discharge valve, a piston drive part supplying a force to the piston to reciprocate the piston via a rod coupled to the piston, and a container part accommodating the compression part and forming a vacuum region around the compression part.

Effects of Invention

The reciprocating compressor which is an embodiment of the present disclosure is capable of suppressing the generation of liquefied air.

DESCRIPTION OF EMBODIMENTS

Figure 1:
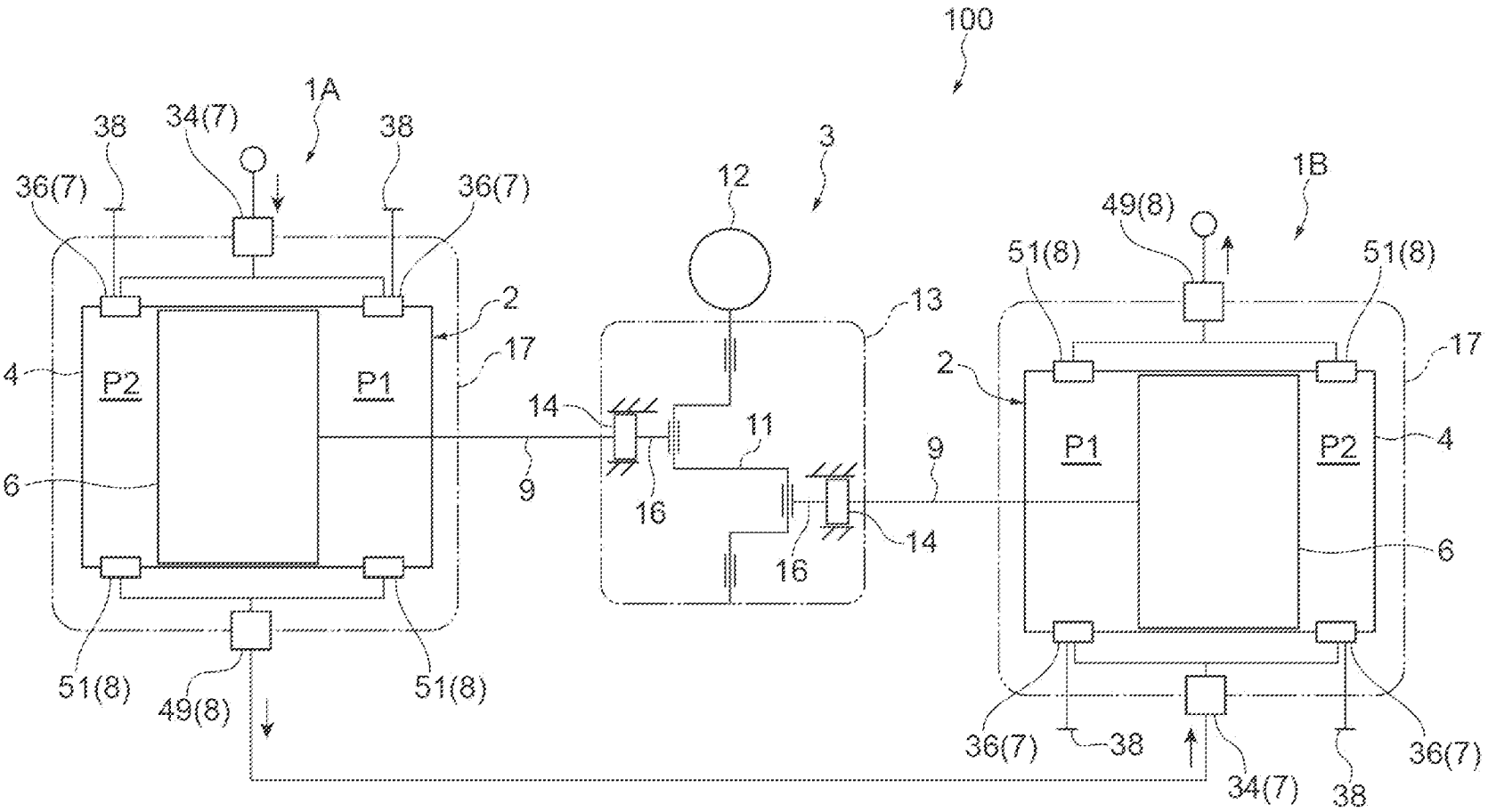
FIG. 1 is a schematic diagram of a BOG compression system having a reciprocating compressor of the embodiment.

A reciprocating compressor which is an embodiment of the present disclosure includes a compression part compressing, by a piston, gas sucked into a cylinder through a suction valve, and discharging the compressed gas through a discharge valve, a piston drive part supplying a force to the piston to reciprocate the piston via a rod coupled to the piston, and a container part accommodating the compression part and forming a vacuum region around the compression part.

In the reciprocating compressor, the compression part that compresses gas is accommodated in the container part. The container part forms a vacuum region around the compression part. As a result, the compression part is thermally insulated from the external region by the vacuum region. That is, excessive cooling of the region surrounding the reciprocating compressor is prevented even when cryogenic gas is supplied to the compression part. The generation of liquefied air can thus be suppressed.

In one embodiment, the container part may include a housing forming the vacuum region, and a cylinder holding part disposed between the housing and the cylinder. A side surface of the cylinder may be spaced from an inner surface of the housing facing the side surface of the cylinder. A first end part of the cylinder holding part may be formed on the side surface of the cylinder. A second end part of the cylinder holding part may be formed on the inner surface of the housing. Such configurations enable the cylinder to be suitably supported. As a result, vibration caused by the reciprocating motion of the piston can be tolerated.

The reciprocating compressor of one embodiment may further include an intermediate tube part disposed between the piston drive part and the container part, and accommodating the rod, and a heat resistive part disposed between the compression part and the intermediate tube part. Such configurations enable the intermediate tube part to be thermally insulated from the compression part. As a result, the influence of the heat of the compression part on the intermediate tube part can be suppressed even when cryogenic gas is supplied to the compression part. That is, excessive cooling of the intermediate tube part is prevented even when cryogenic gas is supplied to the compression part.

In one embodiment, the suction valve may be formed in the cylinder, and may be capable of alternately switching between an open mode allowing entry and exit of the gas to and from the cylinder and a closed mode inhibiting the entry and exit of the gas according to an internal pressure of the cylinder, and the reciprocating compressor may further include an unloader disposed on an outer surface side of the container part, and configured to force the closed mode of the suction valve to be switched to the open mode by receiving a supply of compressed gas. The unloader is disposed outside the container part. The outside of the container part is thermally insulated from the compression part. The unloader is thus not affected by the heat of the compression part. As a result, the unloader is capable of operating reliably.

The reciprocating compressor of one embodiment may further include an intermediate tube part disposed between the piston drive part and the container part, and accommodating the rod. The intermediate tube part may form a first intermediate chamber, a second intermediate chamber, and a third intermediate chamber. The first intermediate chamber, the second intermediate chamber, and the third intermediate chamber may be disposed in the order of the first intermediate chamber, the second intermediate chamber, and the third intermediate chamber in a direction from the piston drive part toward the container part. An internal pressure of the first intermediate chamber may be higher than internal pressures of the second intermediate chamber and the third intermediate chamber. According to these configurations, the first intermediate chamber, the second intermediate chamber, and the third intermediate chamber are formed between the compression part and the piston drive part. The internal pressure of the first intermediate chamber formed closer to the piston drive part is higher than the internal pressures of the second intermediate chamber and the third intermediate chamber. As a result, leakage of gas from the compression part to the piston drive part can be suppressed by this pressure difference. The leakage of cryogenic gas is thus suppressed. As a result, the piston drive part can be reliably operated.

In one embodiment, a liquefaction temperature of the gas may be lower than the liquefaction temperature of oxygen or the liquefaction temperature of nitrogen. The reciprocating compressor of the one embodiment may be suitably applied to such gas.

Embodiments for implementing the reciprocating compressor of the present disclosure will be described below with reference to the accompanying drawings. Like elements are given like reference signs in the description of the drawings and redundant explanation is omitted.

FIG. 1 illustrates a boil-off gas compression system that has reciprocating compressors 1A, 1B. The boil-off gas compression system is referred to as a "BOG compression system 100" in the description below. The BOG compression system 100 is installed in a receiving terminal, a storage terminal, and the like for hydrogen. A storage terminal is equipped with tanks that store liquid hydrogen. Hydrogen gas is generated inside the tanks by the vaporization of the liquid hydrogen. The BOG compression system 100 is used to compress the hydrogen gas.

A case in which the BOG compression system 100 is intended for hydrogen gas is described below as an example. However, the gas for which the BOG compression system 100 is intended is not limited to hydrogen gas. The BOG compression system 100 is also applicable to gas fuel such as natural gas or propane gas. That is, the BOG compression system 100 is applicable to systems that generate BOG. Specifically, the BOG compression system 100 can be suitably used for systems intended for gas having a liquefaction temperature that is lower than the liquefaction temperature of air. Air contains mainly oxygen and nitrogen. The BOG compression system 100 can thus be suitably used for systems intended for gas having a liquefaction temperature that is lower than the liquefaction temperature of oxygen or the liquefaction temperature of nitrogen. Such gas includes hydrogen mentioned above and helium. The simple term "gas" herein broadly refers to gas fuel including natural gas and the like. The term "gas" also narrowly refers to hydrogen gas and the like which have a liquefaction temperature that is lower than the liquefaction temperature of air among gas fuels.

The BOG compression system 100 has the two reciprocating compressors 1A, 1B. The one reciprocating compressor 1A, for example, sucks in hydrogen gas from a tank. The reciprocating compressor 1A then compresses the sucked hydrogen gas. The reciprocating compressor 1A then supplies the compressed hydrogen gas to the other reciprocating compressor 1B. The other reciprocating compressor 1B further compresses the hydrogen gas and then discharges the same. That is, the BOG compression system 100 is a two-stage compression system in which gas compressed by the one reciprocating compressor 1A is further compressed by the other reciprocating compressor 1B. The reciprocating compressors 1A, 1B have compression parts 2 and a piston drive part 3. It should be noted that the number of reciprocating compressors that the BOG compression system 100 has may be selected as appropriate according to the performance required of the BOG compression system 100. For example, the BOG compression system 100 may be a three-stage system having three reciprocating compressors, or a four-stage system having four reciprocating compressors. Additionally, for example, the BOG compression system 100 may be a three-stage system having four reciprocating compressors.

The reciprocating compressors 1A, 1B differ only in their positions, and the details of their configurations are the same. The one reciprocating compressor 1A (left side of the page) will be described in detail below, and the description of the other reciprocating compressor 1B (right side of the page) is omitted.

The compression part 2 has a cylinder 4, a piston 6, a suction mechanism 7, and a discharge mechanism 8. The cylinder 4 and the piston 6 form compression spaces P1, P2 that compress gas. For example, the compression part 2 has two of the compression spaces P1, P2. The suction mechanism 7 and the discharge mechanism 8 are formed to be able to suck and discharge gas into and from the compression spaces P1, P2. The piston 6 has an end part of a piston rod 9 coupled thereto. The other end part of the piston rod 9 is coupled to the piston drive part 3.

The piston drive part 3 has a crank shaft 11. The crank shaft 11 converts rotational motion provided by a drive source 12 into reciprocating motion of the piston rod 9. In addition to the crank shaft 11, the piston drive part 3 has a crank case 13, a crosshead 14, and a connecting rod 16.

Figure 2:
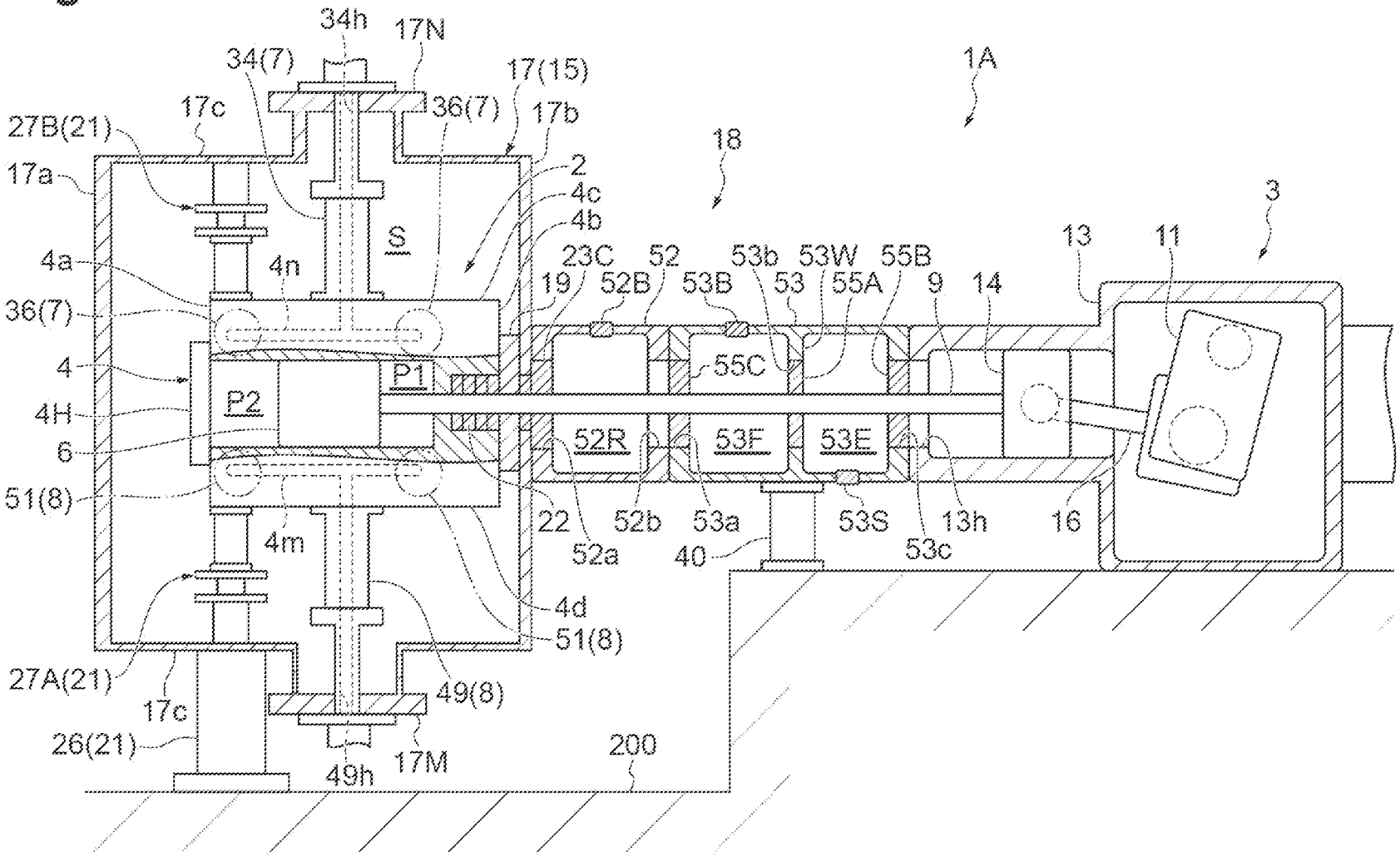
FIG. 2 is a cross-sectional view of the reciprocating compressor as viewed from the side.

As illustrated in FIG. 2, in addition to the compression part 2 and the piston drive part 3, the reciprocating compressor 1A further has a container part 15, an intermediate tube part 18, and a housing heat insulator 19.

The shape of the cylinder 4 of the compression part 2 may be selected as appropriate according to the required performance or condition. For example, the cylinder 4 may have a rectangular cuboid or cylindrical shape. The present disclosure is described with the cylinder 4 having a rectangular cuboid shape. The cylinder 4 is disposed such that the central axis of the cylinder 4 extends along the horizontal direction. A cylinder distal end part 4*a* has an opening. The opening is closed in an airtight manner by a lid 4H. The lid 4H may have a clearance valve. A cylinder base end part 4*b* is fixed to the container part 15. More specifically, the housing heat insulator 19 (heat resistive part) is inserted between the cylinder base end part 4*b* and the container part 15. The housing heat insulator 19 suppresses heat transfer between the cylinder 4 and the container part 15. For example, a heat insulating fiber-reinforced resin such as a glass fiber-reinforced resin may be used as the housing heat insulator 19.

The container part 15 has a housing 17 and a cylinder support 21. The housing 17 forms a receiving space S that accommodates the compression part 2. The pressure of the receiving space S is reduced, and is in a so-called vacuum state. A vacuum pump not shown is connected to the container part 15. The vacuum pump is operated as necessary during the operation of the reciprocating compressor 1A. The vacuuming action of the vacuum pump may be continuous or intermittent. A vacuum state means that the internal pressure of the housing 17 is lower than the atmospheric pressure. That is, there are no limits on the specific value of the internal pressure or the specific degree of vacuum in defining the vacuum state. The receiving space S formed by the housing 17 thermally insulates the compression part 2 from the atmospheric environment. The housing 17 thus forms an insulating part around the compression part 2. That is, the vacuum state of the receiving space S is a state in which a desired insulating effect can be exhibited.

It should be noted that the present disclosure gives an example of a configuration in which the reciprocating compressors 1A, 1B each have the container part 15. For example, it is not necessary for all of the reciprocating compressors 1A, 1B of the BOG compression system 100 to have the container part 15. For example, in the BOG compression system 100, the container part 15 of the reciprocating compressor 1B may be omitted with only the first stage reciprocating compressor 1A having the container part 15.

The shape of the housing 17 is, for example, cylindrical. The housing 17 has a housing distal end part 17*a*, a housing base end part 17*b*, and a housing circumferential wall 17*c*. The space surrounded by the housing distal end part 17*a*, the housing base end part 17*b*, and the housing circumferential wall 17*c* is the receiving space S. The housing base end part 17*b* is fixed to the cylinder 4 via the housing heat insulator 19. The length of the housing 17 in the axial direction is longer than the length of the cylinder 4 in the axial direction. A gap is thus formed between the housing distal end part 17*a* and the cylinder distal end part 4*a*. The diameter of the housing 17 is greater than the height and width of the cylinder 4. Additionally, the central axis of the cylinder 4 roughly overlaps the central axis of the housing 17. A gap is thus also formed between the housing circumferential wall 17*c* and a cylinder upper surface 4*c*. Similarly, a gap is also formed between the housing circumferential wall 17*c* and a cylinder lower surface 4*d*. These gaps are vacuum regions formed around the cylinder 4.

The cylinder base end part 4*b* is fixed to the housing 17. The cylinder distal end part 4*a*, the cylinder upper surface 4*c*, and the cylinder lower surface 4*d* are thus spaced from the housing 17. This is a cantilevered state with the cylinder base end part 4*b* being a support end. As such, a distal end side of the cylinder 4 is supported by the cylinder support 21.

The cylinder support 21 is disposed at a distal end part of the cylinder 4. The cylinder support 21 supports the distal end part of the cylinder 4 in the vertical direction. The cylinder support 21 has an external container support 26, a lower internal container support 27A, and an upper internal container support 27B. The external container support 26, the lower internal container support 27A, and the upper internal container support 27B are disposed on the same reference line that extends along the vertical direction. It should be noted that "disposed on the same reference line" is not limited to a configuration in which axes of the external container support 26, the lower internal container support 27A, and the upper internal container support 27B exactly match a common reference axis. It is only required that the external container support 26, the lower internal container support 27A, and the upper internal container support 27B are disposed to be able to suitably transmit the weight of the cylinder 4 to a base 200.

The external container support 26 is disposed outside the housing 17. More specifically, the external container support 26 is disposed between an outer circumferential surface of the housing circumferential wall 17*c* and the base 200. In other words, an upper end of the external container support 26 is fixed to the outer circumferential surface of the housing circumferential wall 17*c*. A lower end of the external container support 26 is fixed to the base 200.

The lower internal container support 27A is disposed inside the housing 17. More specifically, the lower internal container support 27A is disposed between an inner circumferential surface of the housing circumferential wall 17*c* and the cylinder lower surface 4*d*. The lower internal container support 27A is disposed on the external container support 26 with the housing circumferential wall 17*c* interposed therebetween. According to this structure, the weight of the compression part 2 is transmitted to the base 200 via the lower internal container support 27A, the housing circumferential wall 17*c*, and the external container support 26.

Figure 3:
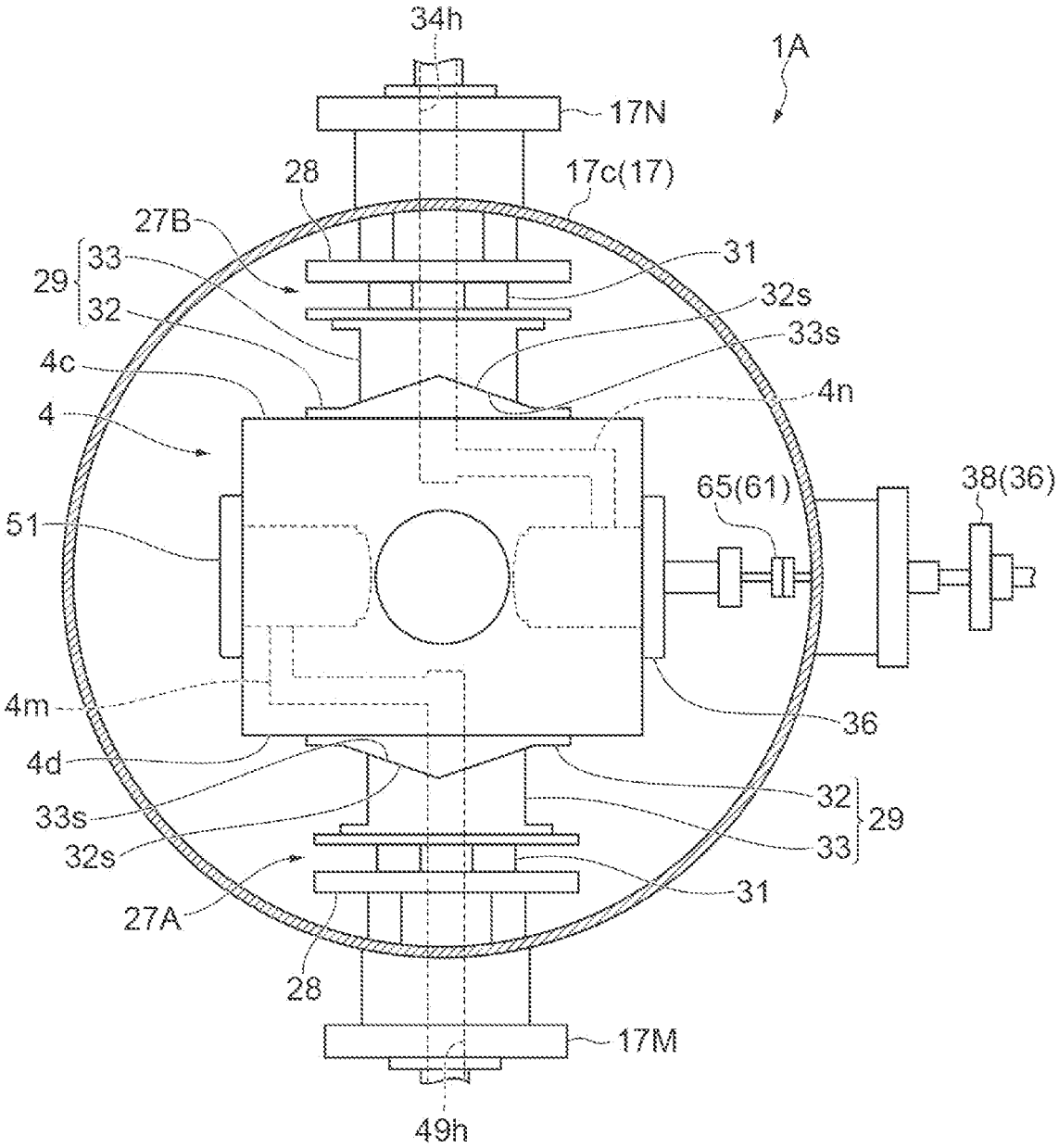
FIG. 3 is a cross-sectional view of the reciprocating compressor as viewed from the front.

As illustrated in FIG. 3, the lower internal container support 27A has an outer circumferential pedestal 28 (second end part), an inner circumferential pedestal 29 (first end part), and an elastic part 31. The outer circumferential pedestal 28 is fixed to the inner circumferential surface of the housing circumferential wall 17*c*. The inner circumferential pedestal 29 is fixed to the cylinder lower surface 4*d*. The elastic part 31 is inserted between the outer circumferential pedestal 28 and the inner circumferential pedestal 29. The elastic part 31 allows the movement of the inner circumferential pedestal 29 relative to the outer circumferential pedestal 28. For example, the elastic part 31 allows the movement of the inner circumferential pedestal 29 in a perpendicular direction relative to the outer circumferential pedestal 28.

The inner circumferential pedestal 29 has a pedestal base part 32 and a pedestal coupling part 33. The pedestal base part 32 is fixed to the cylinder lower surface 4*d*. The pedestal coupling part 33 is fixed to the elastic part 31. At least one of the pedestal base part 32 and the pedestal coupling part 33 may be a heat insulating member. For example, all or a portion of the pedestal coupling part 33 may be formed of a heat insulating resin material. The pedestal base part 32 and the pedestal coupling part 33 are not fixed to each other at the connecting portion thereof. Specifically, a base part main surface 32*s* of the pedestal base part 32 is in contact with a coupling main surface 33*s* of the pedestal coupling part 33. The base part main surface 32*s* has a triangular cross-sectional shape. A ridgeline of the base part main surface 32*s* extends in a movement direction of the piston 6. The coupling main surface 33*s* has a valley-like cross-section. According to this configuration, the pedestal coupling part 33 is movable along the movement direction of the piston 6 relative to the pedestal base part 32.

Vibration of the pedestal base part 32 relative to the pedestal coupling part 33 is generated by the reciprocating motion of the piston 6. The vibration can be reduced by the friction between the base part main surface 32*s* and the coupling main surface 33*s*. More specifically, the lower internal container support 27A follows the relative movement of the cylinder 4. The weight of the cylinder 4 appropriately acts on the lower internal container support 27A. As result, a pressing force and a frictional force are obtained. Thus, the vibration along the direction of the reciprocating motion caused by the movement of the piston 6 is suppressed.

Furthermore, allowing this relative movement allows thermal deformation caused by a difference in temperature between the compression part 2 and the container part 15. For example, when hydrogen gas is supplied to the compression part 2, the cylinder 4 is cooled and may shrink in the movement direction of the piston 6. That is, the relative positional relationship between the compression part 2 and the container part 15 may change. In the lower internal container support 27A, the pedestal base part 32 disposed closer to the cylinder 4 is capable of moving relative to the pedestal coupling part 33 disposed closer to the housing 17. The deformation of the cylinder 4 is thus allowed by the movement of the pedestal base part 32 relative to the pedestal coupling part 33. Consequently, the reciprocating compressor 1A is capable of reducing the generation of unwanted stress by the thermal deformation caused by the temperature difference. The thermal deformation caused by the difference in temperature between the compression part 2 and the container part 15 also causes a change in the relative positional relationship in a direction intersecting the movement direction of the piston 6 (for example, perpendicular direction). The elastic part 31 allows the change in this direction.

It should be noted that the configuration of the pedestal base part 32 and the pedestal coupling part 33 is not limited to that described above. More specifically, the configuration of the base part main surface 32*s* and the coupling main surface 33*s* is not limited to that described above. For example, the concave-convex relationship between the base part main surface and the coupling main surface may be inverted. Alternatively, the base part main surface may be a convex curved surface, and the coupling main surface may be a concave curved surface. Furthermore, the base part main surface and the coupling main surface may have a guiding structure. Specifically, the connecting portion between the pedestal base part and the pedestal coupling part may have a guiding structure that extends in the axial direction. The pedestal base part has at least one ridge. The pedestal coupling part has at least one guide groove. The cross-sectional shape of the ridge is substantially the same as the cross-sectional shape of the guide groove, and the ridge is fitted into the guide groove. The ridge is slidable in the axial direction. However, the ridge cannot move in the direction intersecting the axial direction.

The lower internal container support 27A and the external container support 26 support the weight of the compression part 2 as described above. That is, the lower internal container support 27A forms a cylinder holding part. The pressure inside the housing 17 is reduced. Thus, an external force due to atmospheric pressure acts on the housing 17. The external force, for example, acts in a direction to crush the housing circumferential wall 17*c*. The upper internal container support 27B has thus been provided, in addition to the lower internal container support 27A, as a member to counteract the external force. Similarly to the lower internal container support 27A described above, the upper internal container support 27B also functions to suppress the vibration caused by the movement of the piston 6 by the pressing force of an elastic body.

The upper internal container support 27B is disposed inside the housing 17. More specifically, the upper internal container support 27B is disposed between the inner circumferential surface of the housing circumferential wall 17*c* and the cylinder upper surface 4*c*. Similarly to the lower internal container support 27A, the upper internal container support 27B is disposed above the external container support 26. It should be noted that the configuration of the upper internal container support 27B is the same as that of the lower internal container support 27A. Detailed description of the upper internal container support 27B is thus omitted.

The compression part 2 further has a piston rod packing 22, in addition to the cylinder 4, the piston 6, the suction mechanism 7, and the discharge mechanism 8.

Figure 4:
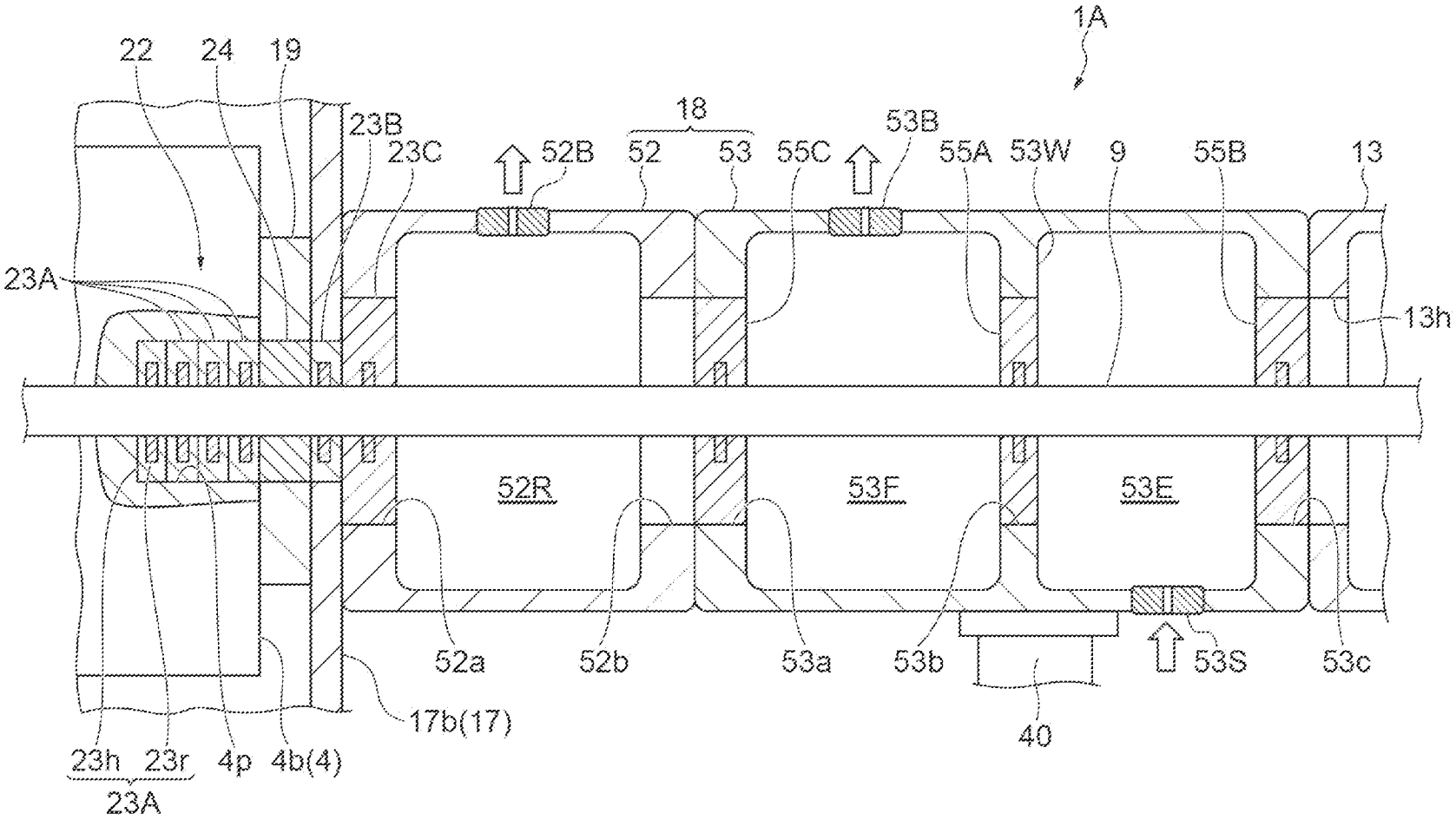
FIG. 4 is an enlarged cross-sectional view of a portion of FIG. 2.

As shown in FIG. 4, a portion of the piston rod packing 22 is disposed in a packing hole 4*p* which has an opening at the cylinder base end part 4*b*. The piston rod packing 22 allows the reciprocating motion of the piston rod 9 relative to the cylinder 4. The piston rod packing 22 also keeps the compression spaces P1, P2 airtight. The piston rod packing 22 functions as a sealing part to suppress leakage of gas from the cylinder 4.

The piston rod packing 22 has a plurality of packing units 23A, 23B, 23C, and an insulating ring 24. Each of the packing units 23A, 23B, 23C has a packing case 23*h* and at least one packing ring 23*r*. The material, shape, and number of the packing ring 23*r* may be selected as appropriate according to the required sealing property of the piston rod packing 22. For example, Teflon (Registered Trademark) may be used as the material of the packing ring 23*r*. The packing units 23A, 23B, 23C are layered in the axial directions thereof to form the piston rod packing 22. This layered structure includes the insulating ring 24 in addition to the packing units 23A, 23B, 23C.

A plurality of the packing units 23A are disposed in the packing hole 4*p* of the cylinder 4. It can be said that the packing units 23A are disposed inside the housing 17. "Inside the housing 17" herein is, in other words, the part affected by the temperature of gas. That is, the packing units 23A are exposed to a cryogenic environment.

The packing units 23B, 23C are disposed outside the packing hole 4*p*. The packing unit 23B may be considered as a portion of the housing 17. The packing unit 23C may be considered as a portion of the intermediate tube part 18. The packing units 23B, 23C are disposed outside the housing 17. "Outside the housing 17" herein is, in other words, the part that does not tend to be affected by the temperature of gas. That is, the packing units 23B, 23C are insulated from the cryogenic environment.

"Inside the housing 17" and "outside the housing 17" described above can be distinguished by the insulating ring 24. That is, the packing unit 23A disposed "inside the housing 17" is disposed closer to the cylinder 4 than the insulating ring 24. The packing units 23B, 23C disposed "outside the housing 17" are disposed closer to the intermediate tube part 18 than the insulating ring 24. In the example illustrated in FIG. 4, the insulating ring 24 is a portion of the housing heat insulator 19. That is, the insulating ring 24 is disposed between the cylinder base end part 4*b* and the housing 17. It should be noted that the insulating ring 24 may be a component different from the housing heat insulator 19. In that case, the insulating ring 24 may be disposed in the packing hole 4*p* of the cylinder 4.

As illustrated in FIG. 2, the suction mechanism 7 guides gas inside the cylinder 4. The gas to be sucked in is, for example, hydrogen gas at −245° C. The suction mechanism 7 has an expansion joint 34, a suction valve 36, and an unloader 38 (see FIG. 5). The expansion joint 34 is disposed between the cylinder 4 and the housing 17. More specifically, one end of the expansion joint 34 is connected to a suction lid 17N of the housing 17. The other end of the expansion joint 34 is connected to the cylinder upper surface 4*c*. A hole 34*h* that forms a gas passage is formed inside the expansion joint 34. The hole 34*h* is connected to a gas introduction hole 4*n* formed in the cylinder 4. The gas introduction hole 4*n* is provided with the suction valve 36. The suction valve 36 alternately switches between a state of allowing the suction of gas (open mode) and a state of inhibiting the suction of gas (closed mode) according to the internal pressures of the compression spaces P1, P2.

Figure 5:
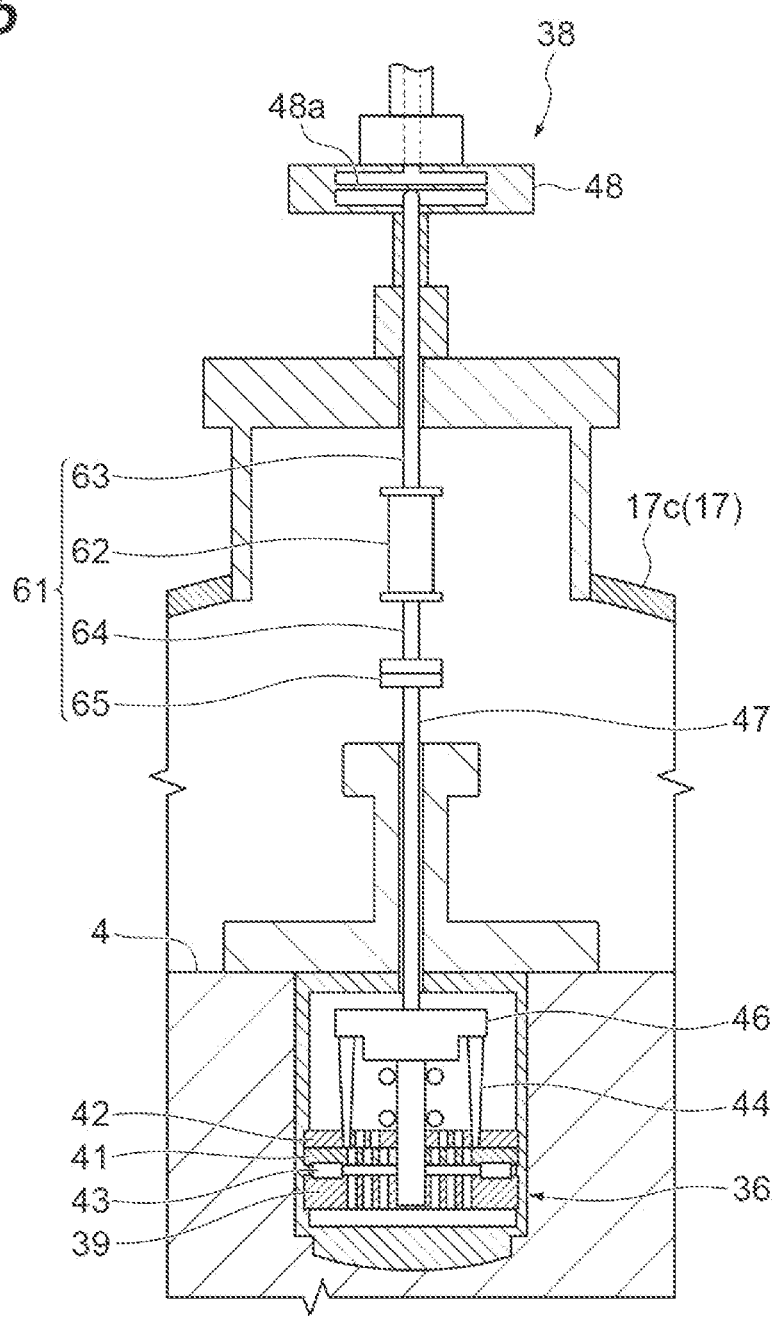
FIG. 5 is a cross-sectional view illustrating a suction mechanism.

As illustrated in FIG. 5, the suction valve 36 opens or closes the gas passage according to the internal pressure of the cylinder 4. The suction valve 36 has a valve guard 39, a valve plate 41, and a valve seat 42. The valve guard 39, the valve plate 41, and the valve seat 42 form a control valve. The valve plate 41 is disposed between the valve guard 39 and the valve seat 42, and is movable therebetween. When the valve plate 41 is in contact with the valve seat 42, the suction valve 36 is in the closed mode. When the valve plate 41 is in contact with the valve guard 39, the suction valve 36 is in the open mode. The open mode and the closed mode are switched according to the internal pressures of the compression spaces P1, P2. For example, the suction valve 36 is in the open mode that allows the entry and exit of gas when the internal pressures of the compression spaces P1, P2 decrease (intake), and the suction valve 36 is in the closed mode that inhibits the entry and exit of gas when the internal pressures of the compression spaces P1, P2 increase (compression).

As illustrated in FIG. 2, the discharge mechanism 8 discharges gas from inside the cylinder 4. The gas to be discharged is, for example, hydrogen gas at −200° C. The discharge mechanism 8 has an expansion joint 49 and a discharge valve 51. The expansion joint 49 is disposed between the cylinder 4 and the housing 17. More specifically, one end of the expansion joint 49 is connected to a discharge lid 17M of the housing 17. The other end of the expansion joint 49 is connected to the cylinder lower surface 4*d*. A through hole 49*h* of the expansion joint 49 is connected to a gas discharge hole 4*m* formed in the cylinder 4. The gas discharge hole 4*m* is provided with the discharge valve 51.

The discharge valve 51 has, similarly to the suction valve 36, the valve guard 39, the valve plate 41, the valve seat 42, and a spring 43. However, the relationship between the internal pressures of the compression spaces P1, P2 and the open and closed modes is different from that of the suction valve 36. That is, the discharge valve 51 is in the closed mode when the internal pressures of the compression spaces P1, P2 decrease (intake), and is in the open mode when the internal pressures of the compression spaces P1, P2 increase (compression).

The reciprocating compressor 1A has the unloader 38 (see FIG. 5) as a capacity adjusting mechanism. The unloader 38 is attached to the suction valve 36.

As illustrated in FIG. 5, the unloader 38 has a yoke bar 44, a yoke plate 46, a yoke rod 61, and a rod drive part 48. A distal end of the yoke bar 44 abuts against the valve plate 41. A base end of the yoke bar 44 is fixed to the yoke plate 46. The yoke plate 46 is a disc, and the yoke rod 61 is fixed to the center thereof. The yoke rod 61 is disposed such that the axis of the yoke rod 61 extends in a direction orthogonal to the reciprocating axis. A base end of the yoke rod 61 projects from the housing circumferential wall 17*c*. The base end of the yoke rod 61 is accommodated in the rod drive part 48. The rod drive part 48 is formed on the outer circumferential surface of the housing circumferential wall 17*c*. The rod drive part 48 controls the position of the yoke rod 61. The rod drive part 48 has, for example, a diaphragm 48*a*. Controlling the pressure difference on opposite sides of the diaphragm 48*a* enables the position of the yoke rod 61 to be controlled. The pressure difference is controlled by the compressed gas supplied to one side of the diaphragm 48*a*.

The yoke rod 61 has a first rod 63, an insulating rod 62, an isolating part 65, and a second rod 64. These parts are disposed in this order from outside the housing 17 toward the cylinder 4. An upper end of the first rod 63 is an upper end of the yoke rod 61. The upper end of the first rod 63 contacts the diaphragm 48*a*. A lower end of the first rod 63 is connected to the insulating rod 62. The insulating rod 62 thermally insulates the first rod 63 which is disposed closer to the housing 17 from the second rod 64 which is disposed closer to the cylinder 4. An upper end of the insulating rod 62 is connected to the lower end of the first rod 63. A lower end of the insulating rod 62 is connected to the isolating part 65. The isolating part 65 enables the first rod 63 and the insulating rod 62 to be detached from the second rod 64. For example, the cylinder 4 heat-shrinks when hydrogen gas is supplied to the cylinder 4. As a result, the relative distance between the cylinder 4 and the housing 17 changes. If the yoke rod 61 were an integrated rod body, tensile stress would act on the rod body. Thus, to deal with an increase in the relative distance between the cylinder 4 and the housing 17, the isolating part 65 is provided so that the first rod 63 and the insulating rod 62 can be detached from the second rod 64. An upper part of the isolating part 65 is connected to the insulating rod 62. A lower part of the isolating part 65 is connected to an upper end of the second rod 64. The upper end of the second rod 64 is connected to a lower end of the isolating part 65. A lower end of the second rod 64 is a lower end of the yoke rod 61, and is connected to the yoke plate 46.

As illustrated in FIG. 4, the suction valve 36 closes when the internal pressures of the compression spaces P1, P2 increase (compression). When the internal pressures of the compression spaces P1, P2 increase, the unloader 38 forces the closed state to be released. Specifically, when the internal pressures of the compression spaces P1, P2 increase, the valve plate 41 comes into contact with the valve seat 42. The unloader 38 releases the contact with the valve seat 42 by pressing the valve plate 41 when capacity control is required. As a result, gas is not compressed in the cylinder 4, so that the internal pressures do not increase. Compressed gas is not supplied since the discharge valve 51 which opens by the increase in the internal pressures of the compression spaces P1, P2 is not opened. The capacity of the reciprocating compressor 1A can thus be adjusted.

The intermediate tube part 18 is disposed between the housing 17 and the piston drive part 3. The intermediate tube part 18 may, for example, be supported by a support 40. The intermediate tube part 18 accommodates the piston rod 9. The intermediate tube part 18 has a front intermediate tube 52 and a rear intermediate tube 53. The front intermediate tube 52 is disposed closer to the housing 17. The rear intermediate tube 53 is disposed closer to the piston drive part 3. It should be noted that, in the intermediate tube part 18, the front intermediate tube 52 and the rear intermediate tube 53 may be integrated. The front intermediate tube 52 is fixed to the housing base end part 17*b*. The front intermediate tube 52 is also fixed to the rear intermediate tube 53.

The front intermediate tube 52 has a hole 52*a* that is formed in a front end part, and a hole 52*b* that is formed in a rear end part. The inner diameters of the holes 52*a*, 52*b* are larger than the outer diameter of the piston rod 9. The packing unit 23C is fitted into the hole 52*a*. That is, the piston rod 9 is inserted through the packing unit 23C at a front end surface. It should be noted that desired parts such as the packing unit may also be disposed in the hole 52*b*.

The front intermediate tube 52 forms a rod packing chamber 52R. The rod packing chamber 52R is filled with the same type of gas as the gas supplied to the compression part 2. For example, when the gas supplied to the compression part 2 is hydrogen gas, the rod packing chamber 52R is filled with hydrogen gas at normal temperature. The front intermediate tube 52 also has a vent 52B for controlling the pressure of the rod packing chamber 52R.

The internal space of the rear intermediate tube 53 is divided by a partition wall 53W. As a result, the rear intermediate tube 53 has a first intermediate chamber 53E and a second intermediate chamber 53F. The first intermediate chamber 53E and the second intermediate chamber 53F are aligned along the axial direction of the piston rod 9. The first intermediate chamber 53E is provided closer to the piston drive part 3. The second intermediate chamber 53F is provided closer to the front intermediate tube 52. The rear intermediate tube 53 has holes 53*a*, 53*b*, 53*c*. The holes 53*a*, 53*b*, 53*c* are for the piston rod 9. Similarly to the holes 52*a*, 52*b*, the inner diameters of the holes 53*a*, 53*b*, 53*c* are larger than the outer diameter of the piston rod 9. The holes 53*a*, 53*b*, 53*c* are coaxial with each other. The holes 53*a*, 53*b*, 53*c* are also coaxial with the holes 52*a*, 52*b* of the front intermediate tube 52. A packing unit 55C is fitted into the hole 53*a*. A packing unit 55A is fitted into the hole 53*b*. A packing unit 55B is fitted into the hole 53*c*.

The first intermediate chamber 53E is filled with nitrogen gas. The first intermediate chamber 53E receives a supply of nitrogen gas from a gas supply part for maintaining the internal pressure. For example, the nitrogen gas is supplied to the first intermediate chamber 53E from a supply part 53S. The gas supply part performs control such that the internal pressure of the first intermediate chamber 53E is a desired pressure. For example, if the nitrogen gas leaks from the packing units 55A, 55B, the internal pressure decreases. With the decrease in the internal pressure as a trigger, the gas supply part supplies the nitrogen gas to the first intermediate chamber 53E.

Ideally there should be no transfer of the nitrogen gas due to the presence of the packing unit 55A between the first intermediate chamber 53E and the second intermediate chamber 53F. However, the packing unit 55A keeps both the first intermediate chamber 53E and the second intermediate chamber 53F airtight as well as allowing the reciprocating motion of the piston rod 9. Thus, a small amount of the nitrogen gas may be transferred between the first intermediate chamber 53E and the second intermediate chamber 53F.

Thus, the internal pressure of the first intermediate chamber 53E is, for example, set higher than the internal pressure of the second intermediate chamber 53F. By setting the internal pressure of the first intermediate chamber 53E higher than the internal pressure of the second intermediate chamber 53F, the direction of travel of the nitrogen gas between the first intermediate chamber 53E and the second intermediate chamber 53F can be determined. That is, the transfer of the nitrogen gas can be limited to a flow from the first intermediate chamber 53E which has a relatively higher internal pressure to the second intermediate chamber 53F which has a relatively lower internal pressure. This configuration suppresses the transfer of cryogenic gas compressed by the cylinder 4 from the second intermediate chamber 53F to the first intermediate chamber 53E. Additionally, hydrogen gas may leak from the rod packing chamber 52R into the second intermediate chamber 53F. The rear intermediate tube 53 has a vent 53B which discharges mixed gas containing hydrogen and nitrogen. The vent 53B is formed in a position corresponding to the second intermediate chamber 53F. It should be noted that the rear intermediate tube 53 may have an oil drain part which discharges oil leaked from the crank case 13.

The reciprocating compressor 1A described above has, as characteristic elements, the housing 17, the cylinder support 21, the housing heat insulator 19, the unloader 38, and the intermediate tube part 18. The operation and effects of each of the elements will be described below.

The reciprocating compressor 1A has the compression part 2, the piston drive part 3, and the housing 17. The compression part 2 compresses, by the piston 6, gas sucked into the cylinder 4 through the suction valve 36, and discharges the compressed gas through the discharge valve 51. The piston drive part 3 supplies a force to the piston 6 to reciprocate the piston 6 via the piston rod 9 coupled to the piston 6. The housing 17 accommodates the compression part 2, and forms a vacuum region around the compression part 2.

In the reciprocating compressor 1A, the compression part 2 that compresses gas is accommodated in the housing 17. The housing 17 forms a vacuum region around the compression part 2. As a result, the compression part 2 is thermally insulated from a region in which the reciprocating compressor 1A is disposed by the vacuum region. Thus, excessive cooling of the region in which the reciprocating compressor 1A is disposed is suppressed even when cryogenic gas is supplied to the compression part 2. Consequently, the generation of liquefied air can be suppressed.

By accommodating the compression part 2 in the housing 17 which is a vacuum vessel, the operating efficiency of the compressor can be improved.

Using a vacuum vessel to thermally insulate the compression part 2 eliminates the need to use foam heat insulation material to thermally insulate the compression part 2. There is no foam heat insulation material with guaranteed performance at temperatures of −200° C. or lower. However, a desired heat insulation performance can be obtained by the housing 17 independent of the use temperature environment. Additionally, the external shape of the compression part 2 is complex, so that it would be difficult to closely adhere a foam heat insulation material to the surface of the compression part 2. However, the housing 17 enables a heat insulating region (vacuum region) to be formed around the compression part 2 independent of the external shape of the compression part 2. A foam heat insulation material is also not suitable for environments in which it will be repeatedly exposed to cryogenic and normal temperatures. Furthermore, if there is a gap between the foam heat insulation material and the compression part, liquefied air may infiltrate into the gap, and the infiltrated air may evaporate. When these infiltration and evaporation are repeated, the foam heat insulation material will tend to deteriorate. It would also be necessary to remove and reinstall the foam heat insulation material when maintaining and servicing the compression part 2. However, the housing 17 can also be suitably applied to such problems.

The container part 15 has the housing 17 and the lower internal container support 27A. The housing 17 forms the vacuum region. The lower internal container support 27A is disposed between the housing 17 and the cylinder 4. The inner circumferential pedestal 29 of the lower internal container support 27A is formed on the cylinder lower surface 4*d*. The outer circumferential pedestal 28 of the lower internal container support 27A is formed on an inner surface of the housing 17. Such configurations enable the cylinder 4 to be suitably supported. As a result, vibration caused by the reciprocating motion of the piston 6 can be tolerated.

The reciprocating compressor 1A further has the housing heat insulator 19. The housing heat insulator 19 is disposed between the cylinder 4 and the housing 17. The cylinder base end part 4*b* is coupled to the housing base end part 17*b*. The housing heat insulator 19 is sandwiched between the cylinder base end part 4*b* and the housing base end part 17*b*. Such configurations enable the cylinder 4 to be thermally insulated from the housing 17. As a result, the influence of the heat of the cylinder 4 on the housing 17 can be suppressed even when cryogenic gas is supplied to the cylinder 4. Thus, excessive cooling of the region in which the reciprocating compressor 1A is disposed is further suppressed.

The rod drive part 48 of the unloader 38 formed in the suction valve 36 is disposed on the outer circumferential surface side of the housing 17. According to this configuration, the rod drive part 48 is disposed outside the housing 17. The outside of the housing 17 is thermally insulated from the compression part 2 by the vacuum region. The unloader 38 can thus operate reliably without being affected by the heat of the compression part 2. Specifically, the unloader 38 receives compressed gas for driving the diaphragm. The compressed gas includes compressed air, compressed nitrogen, or the like. According to the configuration above, the unloader 38 is not affected by the heat of the compression part 2. As a result, the compressed air does not liquefy. Consequently, the unloader 38 is capable of operating reliably.

The reciprocating compressor 1A further has the intermediate tube part 18. The intermediate tube part 18 is disposed between the piston drive part 3 and the container part 15. The intermediate tube part 18 accommodates the piston rod 9. The intermediate tube part 18 forms the first intermediate chamber 53E, the second intermediate chamber 53F, and the rod packing chamber 52R. The first intermediate chamber 53E, the second intermediate chamber 53F, and the rod packing chamber 52R are disposed in the order of the first intermediate chamber 53E, the second intermediate chamber 53F, and the rod packing chamber 52R in a direction from the piston drive part 3 toward the housing 17. The internal pressure of the first intermediate chamber 53E is higher than the internal pressures of the second intermediate chamber 53F and a third intermediate chamber.

According to these configurations, the first intermediate chamber 53E, the second intermediate chamber 53F, and the rod packing chamber 52R are formed between the compression part 2 and the piston drive part 3. The internal pressure of the first intermediate chamber 53E formed closer to the piston drive part 3 is higher than the internal pressures of the second intermediate chamber 53F and the rod packing chamber 52R. As a result, leakage of gas from the compression part 2 to the piston drive part 3 can be suppressed by this pressure difference. By suppressing the leakage of cryogenic gas, the piston drive part 3 can be reliably operated.

Additionally, three chambers are formed between the compression part 2 and the piston drive part 3. This configuration enables the distance from the compression part 2 to the piston drive part 3 to be increased. As a result, the heat of the compression part 2 does not tend to affect the piston drive part 3. Thus, the piston drive part 3 can be reliably operated.

The reciprocating compressors 1A, 1B of the present disclosure have been described above. However, the reciprocating compressors 1A, 1B of the present disclosure may be implemented in various forms without being limited to the embodiments above.

For example, the cylinder 4 of the reciprocating compressor 1A is not directly fixed to the intermediate tube part 18. The housing heat insulator 19 and the housing base end part 17*b* of the housing 17 are inserted between the cylinder 4 and the intermediate tube part 18. For example, the cylinder 4 of the reciprocating compressor may be fixed to the intermediate tube part 18 without the housing 17 interposed therebetween. In this case, a heat insulator is disposed between the cylinder 4 and the intermediate tube part 18 as the heat resistive part. In other words, the heat resistive part contacts both the cylinder 4 and the intermediate tube part 18. The configuration in which the heat resistive part is disposed between the compression part 2 and the intermediate tube part 18 may be a configuration in which only the heat resistive part is disposed between the compression part 2 and the intermediate tube part 18. It may also be a configuration in which, similarly to the embodiments, the heat resistive part and other elements (the housing base end part 17*b* of the housing 17) are inserted between the compression part 2 and the intermediate tube part 18.

A configuration in which nitrogen gas is supplied to the first intermediate chamber 53E has been described as an example of a configuration in which the direction of travel of gas in the intermediate tube part 18 is restricted. The configuration in which the direction of travel of gas is restricted is not limited to this configuration. The configuration in which the direction of travel of gas is restricted may employ, as appropriate, a configuration in which the direction of travel of nitrogen gas can be restricted by managing pressure. For example, a configuration of supplying nitrogen gas to the packing unit 55A may be employed instead of the configuration of supplying nitrogen gas to the first intermediate chamber 53E. In this configuration, the pressure of the nitrogen gas supplied to the packing unit 55A is also set higher than the internal pressure of the second intermediate chamber 53F.

The diaphragm 48*a* driven by compressed gas has been described above as an example of a drive mechanism of the unloader 38. The drive mechanism of the unloader 38 is not limited to this configuration. For example, an air cylinder driven by compressed gas may be provided as the drive mechanism of the unloader 38 instead of the diaphragm 48*a*.

REFERENCE SIGNS LIST

1A, 1B Reciprocating compressor
2 Compression part
3 Piston drive part
4 Cylinder
6 Piston
7 Suction mechanism
8 Discharge mechanism

9 Piston rod
11 Crank shaft
12 Drive source
13 Crank case
14 Crosshead
15 Container part
16 Connecting rod
17 Housing
17N Suction lid
17M Discharge lid
18 Intermediate tube part
19 Housing heat insulator
21 Cylinder support
22 Piston rod packing
23A, 23B, 23C Packing unit
24 Insulating ring
26 External container support
27A Lower internal container support
27B Upper internal container support
28 Outer circumferential pedestal
29 Inner circumferential pedestal
31 Elastic part
32 Pedestal base part
33 Pedestal coupling part
34 Expansion joint
36 Suction valve
38 Unloader
48 Rod drive part
49 Expansion joint
51 Discharge valve
52 Front intermediate tube
52B, 53B Vent
52R Rod packing chamber
53 Rear intermediate tube
53S Supply part
53W Partition wall
61 Yoke rod
100 BOG compression system
200 Base
P1, P2 Compression space
S Receiving space

The invention claimed is:

1. A reciprocating compressor comprising:

a compression part compressing, by a piston, gas sucked into a cylinder through a suction valve, and discharging the compressed gas through a discharge valve;

a piston drive part supplying a force to the piston to reciprocate the piston via a rod coupled to the piston; and a container part accommodating the compression part and forming a vacuum region around the compression part, further comprising an intermediate tube part disposed between the piston drive part and the container part, and accommodating the rod, wherein the intermediate tube part forms a first intermediate chamber, a second intermediate chamber, and a third intermediate chamber, the first intermediate chamber, the second intermediate chamber, and the third intermediate chamber are disposed in the order of the first intermediate chamber, the second intermediate chamber, and the third intermediate chamber in a direction from the piston drive part toward the container part, the first intermediate chamber is filled with a type of gas different from the gas sucked into the cylinder, and the third intermediate chamber is filled with a type of gas identical to the gas sucked into the cylinder.

2. The reciprocating compressor according to claim 1, wherein the suction valve is formed in the cylinder, and is capable of alternately switching between an open mode allowing entry and exit of the gas to and from the cylinder and a closed mode inhibiting the entry and exit of the gas according to an internal pressure of the cylinder, and the reciprocating compressor further includes an unloader disposed on an outer surface side of the container part, and configured to force the closed mode of the suction valve to be switched to the open mode by receiving a supply of compressed gas.

3. The reciprocating compressor according to claim 1, wherein a liquefaction temperature of the gas is lower than the liquefaction temperature of oxygen or the liquefaction temperature of nitrogen.

4. The reciprocating compressor according to claim 1, wherein the gas sucked into the cylinder is hydrogen gas, the first intermediate chamber is filled with nitrogen gas, and the third intermediate chamber is filled with hydrogen gas.

5. A reciprocating compressor comprising:

a compression part compressing, by a piston, gas sucked into a cylinder through a suction valve, and discharging the compressed gas through a discharge valve;

a piston drive part supplying a force to the piston to reciprocate the piston via a rod coupled to the piston; and a container part accommodating the compression part and forming a vacuum region around the compression part, wherein the container part includes a housing forming the vacuum region, and a cylinder holding part disposed between the housing and the cylinder, wherein the cylinder holding part includes a pedestal base part fixed to a side surface of the cylinder, and a pedestal coupling part coupled to the housing via an outer circumferential pedestal being fixed to an inner surface of the housing, and the pedestal coupling part is movable relatively along a movement direction of the piston with respect to the pedestal base part.

6. The reciprocating compressor according to claim 5, wherein a cross-sectional shape of a base part main surface where the pedestal base part is in contact with a pedestal coupling part is triangular, a cross-sectional shape of a coupling main surface of the pedestal coupling part being in contact with the base part main surface is valley like, and a ridgeline of the base part main surface extends in the movement direction of the piston.

7. The reciprocating compressor according to claim 5, wherein the cylinder holding part further comprises an elastic part interposed between the pedestal coupling part and the outer circumferential pedestal, and being fixed to the pedestal coupling part.

8. The reciprocating compressor according to claim 7, wherein the elastic part allows the pedestal coupling part and the pedestal base part to move relatively with respect to the outer circumferential pedestal.

9. The reciprocating compressor according to claim 7, wherein the elastic part allows the pedestal coupling part and the pedestal base part to move in a direction orthogonal to the movement direction of the piston with respect to the outer circumferential pedestal.

* * * * *